US007956700B2

(12) United States Patent
Rosenberg et al.

(10) Patent No.: US 7,956,700 B2
(45) Date of Patent: Jun. 7, 2011

(54) WAVEGUIDE JUNCTION

(75) Inventors: Uwe Rosenberg, Backnang (DE); Ulrich Mahr, Backnang (DE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 473 days.

(21) Appl. No.: 12/063,179

(22) PCT Filed: Jul. 26, 2006

(86) PCT No.: PCT/EP2006/064665

§ 371 (c)(1), (2), (4) Date: Mar. 3, 2008

(87) PCT Pub. No.: WO2007/017379

PCT Pub. Date: Feb. 15, 2007

(65) Prior Publication Data

US 2010/0134217 A1 Jun. 3, 2010

(30) Foreign Application Priority Data

Aug. 10, 2005 (GB) ..... 0516416.5

(51) Int. Cl.
*H01P 1/02* (2006.01)
*H01P 1/165* (2006.01)

(52) U.S. Cl. ..... 333/21 A; 333/33

(58) Field of Classification Search ..... 333/21 A, 333/21 R, 208, 209, 248, 33
See application file for complete search history.

(56) References Cited

U.S. PATENT DOCUMENTS

| | | | | |
|---|---|---|---|---|
| 2,729,794 | A * | 1/1956 | Cohn | 333/21 A |
| 4,260,961 | A | 4/1981 | Beis | |
| 4,311,973 | A | 1/1982 | Nuding et al. | |
| 2002/0017966 | A1 | 2/2002 | Seewig | |

FOREIGN PATENT DOCUMENTS

| | | |
|---|---|---|
| EP | 0 247 794 | 5/1987 |
| EP | 0392999 A1 | 10/1990 |
| GB | 1299032 | 12/1972 |

* cited by examiner

*Primary Examiner* — Benny Lee
*Assistant Examiner* — Gerald Stevens
(74) *Attorney, Agent, or Firm* — Coats & Bennett, P.L.L.C.

(57) ABSTRACT

A junction (100) for connecting two waveguides (102, 104) having a first angular offset (α) between longitudinal symmetry axes of their cross-sections, said junction (100) comprising a first interface and a second interlace for connecting said waveguides (102, 104). The junction further comprises at least a first transformer section (106) and a second transformer section (108), both having cross-sections of substantially rectangular shape, and both having said first angular offset (α) between longitudinal symmetry axes of their cross-sections. Each of said transformer sections (106, 108) has two protruded ridges (202, 204, 206, 208) on its opposite walls.

10 Claims, 3 Drawing Sheets

WAVEGUIDE JUNCTION

FIELD OF THE INVENTION

The present invention relates to a waveguide junction for connection waveguides that exhibit an angular offset.

BACKGROUND OF THE INVENTION

Waveguide twists are used to rotate the field orientation for matching two waveguides exhibiting an angular offset. In solutions known in the art the vector of the electric field is rotated in intermediate waveguide sections with appropriate angular steps from the input to the output waveguide. Each angular step gives rise to a partial reflection of the wave depending on the angular increment. In a proper design, these partial reflections should cancel at the center frequency; therefore the length of each section is favourably in the order of a quarter waveguide wavelength (or an odd multiple thereof). The overall bandwidth depends on the number of waveguide sections.

State-of-the-art waveguide twists are commonly based on step-twist sections as e.g. introduced in Wheeler, H. A., et al.,"Step-twist waveguide components", IRE Trans. Microwave Theory Tech., vol. MTT-3, pp. 44-52, October 1955. A suitable realization of this design in one piece is possible by machining the structure from the flange faces with state-of-the-art CNC milling techniques. However such a design is only possible for not more than two transformer steps, which yields substantial limitations for the achievable performance (i.e., Voltage Standing Wave Ratio, VSWR, and bandwidth). The length of the component is determined by the frequency band, i.e. length of each transformer step a quarter waveguide wavelength of the center frequency of the operating band. Another drawback of the prior art solutions results from the fact, that this solution would commonly exhibit an angular offset at the flange interconnections (interfaces). In consequence a specific (i.e. non-standard) flange sealing is necessary when using this component in sealed (pressurized) waveguide systems.

Alternative solutions known in the art are those consisting of two parts that have to be connected to form fully functional junction. Two part format of these junctions allows for more complicated machining and in consequence achieving improved performance, but manufacturing of such junctions is complicated, expensive and time consuming. If two (or more) parts are used they need to be combined in an appropriate way, which increases the manufacturing effort and expense. They could be assembled by screws—but such a solution needs additional sealing means in the parting plane if the component is used in a pressurized waveguide system. Another approach could be the combination by soldering or brazing—however, such solutions need the careful choice of the basic (and surface) material and the overall construction to accommodate with the requirements of the additional process. Moreover the realization of the component from two (or more) parts yields additional tolerances (e.g., fitting of the parts) that may impair the optimal performance.

Hence, an improved waveguide junction would be advantageous and in particular one that has good performance characteristics and is easy for manufacturing.

SUMMARY OF THE INVENTION

Accordingly, the invention seeks to preferably mitigate, alleviate or eliminate one or more of the disadvantages mentioned above singly or in any combination.

According to a first aspect of the present invention there is provided a junction for connecting two waveguides having a first angular offset between longitudinal symmetry axes of their cross-sections. Said junction comprises a first interface and a second interface for connecting said waveguides, and further comprises at least a first transformer section and a second transformer section. Both these transformer sections have cross-sections of substantially rectangular shape, and both have said first angular offset between longitudinal symmetry axes of their cross-sections, wherein each of said transformer sections has two protruded ridges on its opposite walls.

Preferably the junction comprises four transformer sections, two on each side of the junction, wherein a third transformer section is connected to the first transformer section with no angular offset and a fourth transformer section is connected to the second transformer section with no angular offset, wherein a second clearance between the ridges in the third and fourth transformer sections is smaller than a first clearance between the ridges in the first and second transformer sections.

Advantageously for said angular offset substantially in a range from 0° up to 60° the ridges are located substantially at the center of the walls of the transformer sections, and also advantageously for said angular offset substantially in a range from 60° up to 90° the ridges are shifted in opposite directions of the walls of the transformer sections.

Further features of the present inventions are as claimed in the dependent claims.

The present invention beneficially allows for the interconnection of waveguides that exhibit an angular offset (from 0° up to 90°)—providing compact size, easy manufacturing from one solid block of metal and high performance properties (extreme low VSWR) over broad frequency bands (up to the determined operating band of standard waveguides with typically 40% bandwidth). The junction exhibits no angular offset to the connecting waveguides and consequently there are no problems with any standard flange interconnections (e.g. in sealed waveguide systems). In addition the length of the manufactured part can be fitted to overall assembly requirements—it depends no longer on the operating frequency band.

BRIEF DESCRIPTION OF THE DRAWINGS

The present invention will be understood and appreciated more fully from the following detailed description taken in conjunction with the drawings in which.

DETAILED DESCRIPTION OF THE INVENTION

Figure 1:
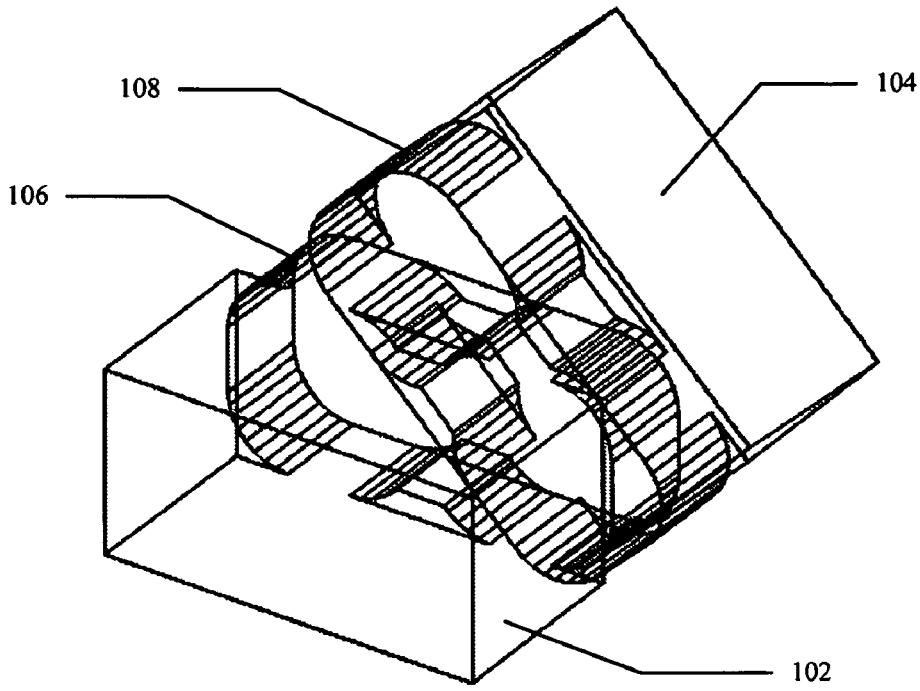
FIG. 1 is a schematic diagram illustrating a junction for connecting two waveguides in accordance with one embodiment of the present invention.
Figure 2:
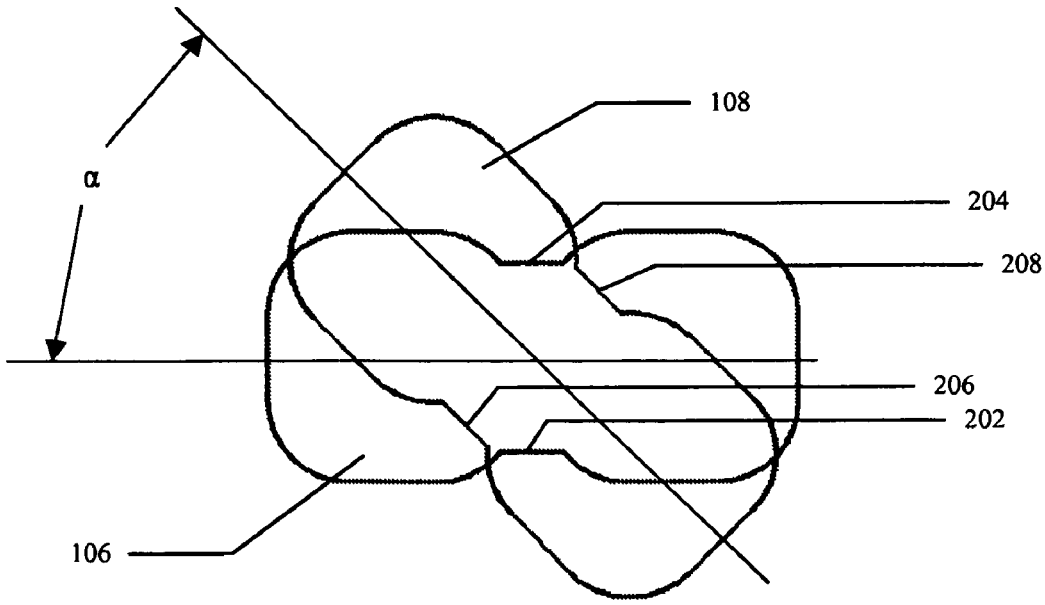
FIG. 2 is a cross-section of the transformer sections illustrating an angular offset of transformer sections of the junction illustrated in FIG. 1 in accordance with one embodiment of the present invention.

With reference to FIG. 1 and FIG. 2 a junction 100 for connecting two waveguides is presented. For the sake of clarity the drawings present the invention in a very schematic way with elements and lines not essential for understanding the invention omitted.

The principle of the invention is depicted in FIG. 1 and FIG. 2 for a 45° waveguide junction 100 (i.e. the first angular offset α between longitudinal symmetry axes of cross-sections of these waveguides is (45°). In alternative embodiments the angular offset α can be below 45°. A first rectangular waveguide 102 is connected, via a first interface, to a first transformer section 106 of the junction 100. The first transformer section 106 has the same orientation as the first waveguide 102 (i.e., there is no angular offset). Similarly a second rectangular waveguide 104 is connected, via a second interface, to a second transformer section 108 of the junction 100, which has the same orientation as the second waveguide 104. Both transformer sections 106 and 108 have cross-sections of substantially rectangular shape, and both have said first angular offset α between longitudinal symmetry axes of their cross-sections equal 45°. Each of the transformer sections 106, 108 have two ridges 202, 204, 206, 208 respectively in the center of the opposite broad walls along the length of the section. So the complete 45° offset is realised by the respective 45° angular offset α of the first and second transformer sections 106, 108. The ridges 202, 204, 206, 208 have flat tops.

In an empty rectangular waveguide the vector of the electric field of the fundamental waveguide mode (TE10—mode) is always perpendicular to the width (broad dimension) of the waveguide. The same holds for the main component of the electrical field of the fundamental mode in transformer sections 106, 108 with ridges 202, 204, 206, 208. The twist of the transmitted wave (the change of the direction of the vector of the electric field) builds on a concentration of the electrical field by the ridges 202, 204, 206, 208 at the angular step. In addition, the electric fields at both sides must have the same field components to obtain an appropriate coupling/transfer of the energy. These prerequisites can be obtained with symmetrical ridges for angular offsets of more than 45°.

Figure 5:
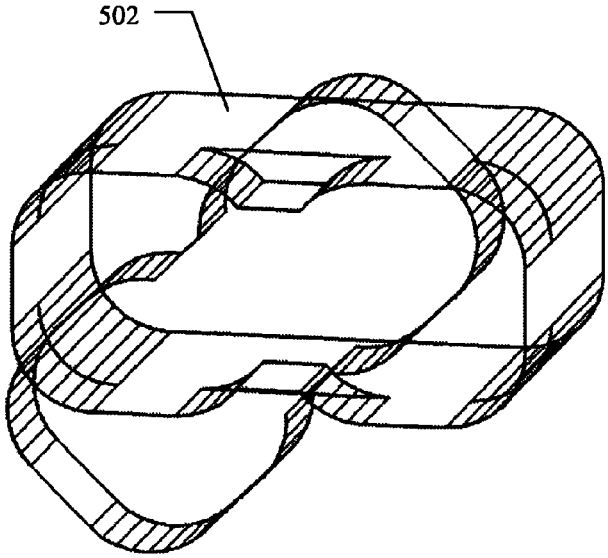
FIG. 5 is a schematic diagram illustrating junction with a waveguide extension in accordance with one embodiment of the present invention.

It should be noted, that due to the loading by the ridges 202, 204, 206, 208 the cut-off frequency of the transformer sections 106, 108 is significantly lower than that of a waveguide known in the art. This fact allows for significantly shorter transformer sections 106, 108 compared with the solutions known in the art, i.e., the junction in accordance with the present invention is more compact. However, the invention offers also the possibility to adapt its length to specific requirements, which sometimes would help to avoid additional waveguide hardware. This is obtained in the following way: since the transformer sections 106, 108 have the same orientation as the connected waveguides 102, 104, additional arbitrary waveguide 502, seen in FIG. 5, can be located between the first transformer section 106 and the first interface. Similarly an additional waveguide section can be located between the second transformer section 108 and the second interlace.

Figure 3:
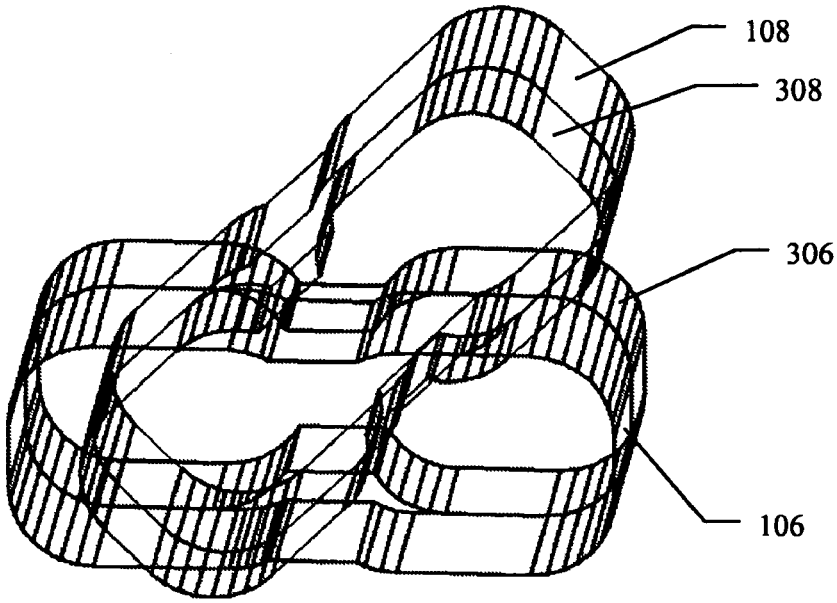
FIG. 3 is a schematic diagram illustrating four transformer sections of the junction in accordance with one embodiment of the present invention.
Figure 4:
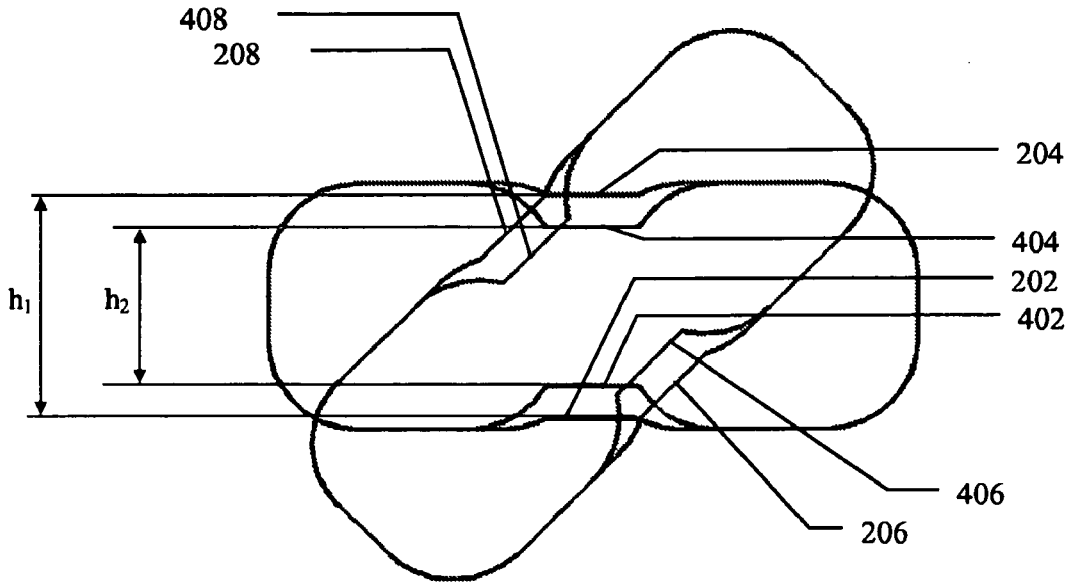
FIG. 4 is a cross-section of the transformer sections of the junction in accordance with one embodiment of the present invention.

The described structure with two transformer sections 106 and 108 is suitable for designs with an operating bandwidth of up to 25% (VSWR e.g.<1.02). For larger bandwidth requirements, additional transformer sections must be considered. FIG. 3 and FIG. 4 depicts an embodiment of the invention with four transformer sections 106, 108, 306, 308 two of which are cascaded connecting at one side the interface waveguide and at the opposite one the other transformer sections with 45 degree alignment.

In this alternative embodiment the junction 100 comprises four transformer sections 106, 108, 306, 308, two on each side of the junction. A third transformer section 306 is connected to the first transformer section 106 wherein the third and first transformer sections have the same angular orientation. A fourth transformer section 308 is connected to the second transformer section 108 and the fourth and second transformer sections have the same angular orientation. The third and fourth transformer sections have ridges 402, 404 and 406, 408 located in the center of the opposite broad walls of the respective transformer sections along the length of the section. A second clearance $h_2$ between the ridges 402, 404 and 406, 408 in the third and fourth transformer sections 306, 308 is smaller than a first clearance $h_1$ between the ridges 202, 204 and 206, 208 in the first and second transformer sections 106, 108. This results in geometry of the junction 100 that allows for easy manufacturing from one solid block of metal. The ridges 202, 204, 206, 208 402, 404, 406, 408 have flat tops.

Generally, the transformer sections 106, 108, 306, 308 have the same dimensions of cross-sections. Transformation (twisting the orientation of the electric and magnetic vectors of the transmitted wave) is obtained by different dimensions of the ridges of the inner (i.e. third and fourth 306, 308) and the outer (i.e. first and second 106, 108) transformer sections. The fact that the clearance between the ridges is, in general, smaller in the third and fourth transformer sections 306 and 308 than in the first and second transformer sections 106 and 108, maintains the favorable production properties for the junction. However, it should be noted, that in alternative embodiments the third and fourth transformer sections 306, 308 need not to have the same overall cross section dimensions as the first and second transformer sections 106, 108. In special designs a smaller cross-section of the third and fourth sections 306, 308 may be used for further performance improvements while allowing still easy manufacturing.

The solution with four transformer sections is applicable for solutions with larger bandwidth than solutions with two transformer sections. The solution with four transformer sections allows for operating bandwidth of up to 40% (VSWR e.g.<1.02), wherein the solution with two transformer sections allows for operating bandwidth of up to 25% (VSWR e.g.<1.02).

In embodiments of the present invention, where said first angular offset α is substantially in a range from 0° up to 60° the ridges 202, 204, 206, 208, 402, 404, 406, 408 are located substantially at the center of the walls of the transformer sections 106, 108, 306, 308.

The general principle of transformation of the orientation of the electric field vector discussed above for 45° angular also applies for offset angles in a range up to 90°. In case of angular offsets in the order of 90° a structure with symmetrical ridges would also concentrate the electrical fields but the field components would be almost perpendicular at both sides, i.e., coupling/transfer of the energy would hardly be possible (and at 90° impossible). As for the 90° case the symmetrical cross-section of the transformer sections with an on-axis perpendicular alignment would cause total reflection and therefore not allow any signal transfer through the junction structure the structure used for smaller angles is modified in such a way that the ridges 602, 604, 606, 608 are no longer situated at the center of the wave guide broad wall. One of the ridges is moved to the left and the other the same distance to the right. The ridges are shifted to maintain the concentration of the electrical fields between the ridges and to achieve same electric field components at the angular offset step by an appropriate field distortion at both sides. In consequence, in alternative embodiments of the present invention, where said first angular offset α is substantially in a range from 60° up to 90° the ridges 602, 604, 606, 608 are shifted in opposite directions of the walls of the transformer sections 106, 108, 306, 308 as it is illustrated in FIG. 6.

Figure 6:
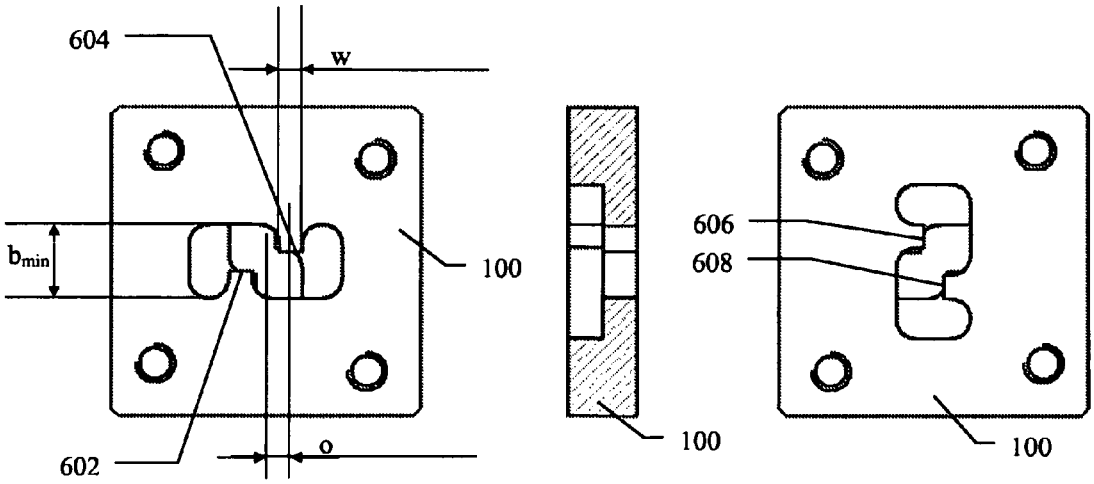
FIG. 6 is a diagram illustrating junction for connection waveguides with 90° angular offset in accordance with one embodiment of the present invention.

With reference to FIG. 6, in junctions with large angular offsets (60°-90°; in the embodiment illustrated on FIG. 6 the angular offset α is 90°) and with ridges shifted off from the center position the offset position of the ridges in the common square window is $$o<(b_{min}-w)/2$$

where:

$b_{min}$—length of the narrow side of the smallest waveguide section (smallest refers to a situation when the transformer sections have different dimensions);

w—width of the ridge;

o—offset of the ridge from the center, and the term common square window means the cross section which is visible through the component, which is determined by the overlapping of inner transformer steps at the angular offset.

The lengths of the sections are between $\lambda_i/8$ and $\lambda_i/4$, $\lambda_i$ being the waveguide wavelength of the fundamental mode in the i-th section at the center frequency $f_0$.

All said sections 106, 108, 306, 308 of said junction 100 have the same symmetry axis and the interfaces are adapted to connect the waveguides 102, 104 in a way that the waveguides 102, 104 also have the same symmetry axis as the sections of the junction 100. The fact, that the interfaces of the junction always exhibit the same orientation as the waveguides, facilitates the implementation of standard sealing means, which are e.g., necessary for the application in pressurized waveguide systems.

In alternative embodiments of the present invention a junction with e.g., 3 transformer sections is also possible. In such case we would have one transformer section having the same angular alignment as the first interface waveguide and the remaining two with the angular alignment of the second interface waveguide. The angular offset occurs then between the first part of the transformer with one section and the second part with the two sections. In that solution the clearances between the ridges for all three sections are different (the junction is no longer symmetric with respect to the plane of the angular offset). The design of the first section will be in accordance with one section e.g. 106 of the junction as presented in FIG. 1 and the two-section part design will be similar the two-section half e.g. 108, 308 of FIG. 3.

The junction is preferably manufactured from one block of metal in the process of milling. However it is within the contemplation of the invention that alternative methods of machining can also be used. In principle, the component could easily be manufactured as diecast also—from aluminium or even from metallized plastic. In case of milling the junction exhibits some radii in the corners. However, complete rectangular shapes are also possible—that could be a suitable solution for high quantity production by e.g. diecasting with aluminium or silver-plated plastic.

The invention claimed is:

1. A junction for connecting two waveguides having a first angular offset (α) between longitudinal symmetry axes of their respective cross-sections, said junction comprising:

a first interface and a second interface configured to connect said two waveguides;

at least a first transformer section and a second transformer section, both having cross-sections of substantially rectangular shape, and both having said first angular offset (α) between longitudinal symmetry axes of their respective cross-sections, each said first and second transformer section having a pair of ridges formed on opposite walls; and third and fourth transformer sections, each having a plurality of ridges formed on opposite walls, and being disposed about the junction such that there are two transformer sections disposed on each side of the junction;

wherein the third transformer section is connected to the first transformer section with no angular offset, and the fourth transformer section is connected to the second transformer section with no angular offset, and wherein a second clearance $h_2$ between the plurality of ridges in the third and fourth transformer sections is smaller than a first clearance $h_1$ between the respective pair of ridges in the first and second transformer sections.

2. The junction of claim 1 wherein each of the ridges are located substantially at the center of the opposite walls of the first and second transformer sections when said first angular offset (α) is substantially in a range between about 0° and 60°.

3. The junction of claim 1 wherein each of the ridges are shifted in opposite directions of the opposite walls of the first and second transformer sections when said first angular offset (α) is substantially in a range between about 60° and 90°.

4. The junction of claim 1 wherein each of the first and second transformer sections include opposing broad walls, and wherein the pair of ridges are disposed on the opposing broad walls of each of the first and second transformer sections, respectively.

5. The junction of claim 1 wherein cross-sectional dimensions of the first and second transformer sections are substantially the same.

6. The junction of claim 1 wherein cross-sectional dimensions of the third and fourth transformer sections are smaller than corresponding cross-sectional dimensions of the first and second transformer sections.

7. The junction of claim 1 wherein said first and second transformer sections comprise substantially the same longitudinal symmetry axis, and wherein the first and second interfaces are configured to connect the two waveguides such that the waveguides have the same longitudinal symmetry axis as the first and second transformer sections.

8. The junction of claim 1 wherein each of the ridges include flat tops.

9. The junction of claim 1 further comprising a first waveguide extension located between the first transformer section and the first interface, and a second waveguide extension located between the second transformer section and the second interface.

10. The junction of claim 1 wherein said junction is manufactured from a unitary metal block.

* * * * *

UNITED STATES PATENT AND TRADEMARK OFFICE

CERTIFICATE OF CORRECTION

PATENT NO. : 7,956,700 B2
APPLICATION NO. : 12/063179
DATED : June 7, 2011
INVENTOR(S) : Rosenberg et al.

It is certified that error appears in the above-identified patent and that said Letters Patent is hereby corrected as shown below:

On the title page, item (57), under "ABSTRACT", in Column 2, Line 4, delete "interlace" and insert -- interface --, therefor.

In Fig. 1, Sheet 1 of 3, insert Tag -- 100 --.

In Fig. 2, Sheet 1 of 3, insert Tag -- 100 --.

In Column 2, Line 53, delete "invention," and insert -- invention; --, therefor.

In Column 3, Line 63, delete "interlace." and insert -- interface. --, therefor.

Signed and Sealed this
Thirteenth Day of March, 2012

David J. Kappos

David J. Kappos
*Director of the United States Patent and Trademark Office*